US008191893B2

(12) United States Patent
Cammegh et al.

(10) Patent No.: US 8,191,893 B2
(45) Date of Patent: Jun. 5, 2012

(54) GAMING APPARATUS

(75) Inventors: Richard Cammegh, Kent (GB); Andrew Cammegh, Kent (GB)

(73) Assignee: Cammegh Limited, Kent (GB)

( * ) Notice: Subject to any disclaimer, the term of this patent is extended or adjusted under 35 U.S.C. 154(b) by 205 days.

(21) Appl. No.: 12/603,782

(22) Filed: Oct. 22, 2009

(65) Prior Publication Data

US 2010/0109237 A1 May 6, 2010

(30) Foreign Application Priority Data

Oct. 27, 2008 (GB) ..... 0819588.5

(51) Int. Cl.
*A63F 5/02* (2006.01)

(52) U.S. Cl. ..... 273/142 E; 273/142 R; 273/142 JB; 463/17

(58) Field of Classification Search ..... 273/142 E, 273/142 F, 142 G, 142 R, 142 A, 142 B, 142 C, 273/142 D, 142 H, 142 HA, 142 J, 142 JA, 273/142 JB, 142 JC, 142 JD, 274; 463/17
See application file for complete search history.

(56) References Cited

U.S. PATENT DOCUMENTS

| | | | | |
|---|---|---|---|---|
| 3,633,916 | A * | 1/1972 | Thomas | 273/142 HA |
| 4,036,502 | A * | 7/1977 | Levy | 273/142 J |
| 4,601,470 | A * | 7/1986 | Kadota et al. | 273/142 E |
| 5,636,838 | A * | 6/1997 | Caro | 273/142 E |
| 5,687,967 | A * | 11/1997 | Klaus | 273/142 E |
| 6,164,647 | A * | 12/2000 | Chee | 273/142 R |
| 6,520,854 | B1 * | 2/2003 | McNally | 463/17 |
| 2005/0288089 | A1 * | 12/2005 | Cammegh et al. | 463/17 |

* cited by examiner

*Primary Examiner* — Benjamin Layno
(74) *Attorney, Agent, or Firm* — Barnes & Thornburg LLP

(57) ABSTRACT

A gaming apparatus comprising a rotor control means adapted to apply an external force to a rotor of the gaming apparatus so as to alter a rotation speed of the rotor in a controlled manner.

12 Claims, 5 Drawing Sheets

GAMING APPARATUS

The present invention relates to gaming apparatus, more particularly it relates to roulette wheels in which the wheel is manually rotated.

BACKGROUND

Roulette is a well-known casino game which has been played for many years. A typical roulette wheel includes a number ring bearing a circular array of numbered segments bearing numbers 1 through 36. In addition, the number ring typically includes the numbers 0 and 00 disposed at diametrically opposite locations on the number ring, or a "0" on its own. The numbers 1 through 36 are not disposed in numerical order, but are typically disposed in a predetermined arrangement, such that roulette wheels located in different casinos will have the same standard predetermined number ring arrangement. The numbers disposed in a circular array in the number ring region of the wheel bear the alternating colours of red and black, with the exception of the 0 and 00 numbers, which are typically coloured green. A ring of pockets corresponding in number to the plurality of numbers of the circular number ring lies adjacent, but radially inward of the number ring, on the typical roulette wheel. In addition, a typical roulette wheel includes a circular, inclined ball track, disposed above, and radially outwardly of the number ring.

In operation of a typical roulette game, players place chips or tokens on a betting layout located on a roulette table, and then the croupier or dealer manually spins the roulette wheel and then places the ball in motion about the circular ball track. As the wheel slows, the ball moves radially inwardly and comes to rest in one of the pockets associated with a particular number of the number ring. After the ball comes to rest in one of the pockets, the croupier or dealer settles the various wagers placed on the table layout in accordance with predetermined rules and wager odds and the process is repeated.

One of the reasons roulette has had enjoyed enduring success is the unpredictability of the outcome of the roulette wheel. This is now under threat since prediction devices have been devised which are capable of being taken into casinos and giving a dynamic prediction of which sector of the wheel rotor the ball will land in. Such prediction devices work in a variety of ways but a general underlying principle of these devices relies on measuring the rotation speed of the rotor, decelerating slowly, and the speed of the ball, which decelerates more rapidly on the ball track in a predictable manner, and calculating a predicted finishing position of the ball based on a relationship between the speed of the rotor and the speed of the ball.

Because the house odds on a standard European roulette wheel are approximately 2.7%, a small number of accurate predictions can rapidly move the odds in the advantage of the player.

To address the problem of prediction devices, roulette wheel manufacturers have attempted to increase the "randomness" of roulette wheels by making wheels with shallower pockets, bouncier surfaces, lower profiles, etc. However, as the prediction devices become more sophisticated, the problem persists.

SUMMARY OF THE INVENTION

The invention provides a gaming apparatus comprising rotor control means adapted to apply a force to a rotor of the apparatus so as to alter a rotation speed of the rotor in a controlled manner.

The apparatus is particularly suitable for use in playing roulette but it can be used for any other game which is played on a roulette wheel or roulette type wheel and can include games in which more than one ball is in play during the game.

According to an aspect of the invention there is provided a gaming apparatus comprising: a rotatably mounted rotor having pockets into which a ball can be received, the rotor being adapted to be spun by a manually applied force; and rotor control means adapted to apply a force to the rotor so as to alter a rotation speed of the rotor in a controlled manner, wherein the rotor control means are adapted to vary the applied force.

The rotor may be able to be rotated in both directions, and so the rotor control means may be adapted to alter a rotation speed in either direction.

Preferably a plurality of ball stops/interrupters may be uniformly located around the peripheral inclined surface to introduce further unpredictability to the fall of the ball to the rotor pockets; in a typical wheel there can be six or eight ball stops. In addition, to incorporate further random effects the direction and/or amplitude of an external force applied to the rotor by the rotor control means may be varied in each game or randomised so there is reduced predictability about rotor speed.

The operation of the rotor control means may be computer controlled.

There may be a fixed outer rim peripherally outward and at the top of the ball track which can incorporate a ball reader so that the position of the ball in apparatus is automatically noted and recorded. A suitable reader is described in Patent Application WO 01/32278. Sensors may also be provided at the outer rim to detect the presence of a ball and/or the measure the speed of the ball on the ball track.

The gaming apparatus may comprise a manually spun roulette wheel. Such a manual roulette wheel may comprise a motor drive and automatic engagement/disengagement mechanism enabling the rotor to come under motor control during the course of a game.

A particular feature of the present invention is that it does not affect the general structure or operation of a conventional roulette wheel, making it easier to maintain the randomness of the wheel with the ball being in sight of the players at all times.

Embodiments may enable a traditional manually operated wheel to be replaced without any changes being needed to an existing supporting table.

BRIEF DESCRIPTION OF THE DRAWINGS

Preferred embodiments of the invention will now be described with reference to the accompanying drawings in which.

DETAILED DESCRIPTION OF EMBODIMENTS OF THE INVENTION

Figure 1:
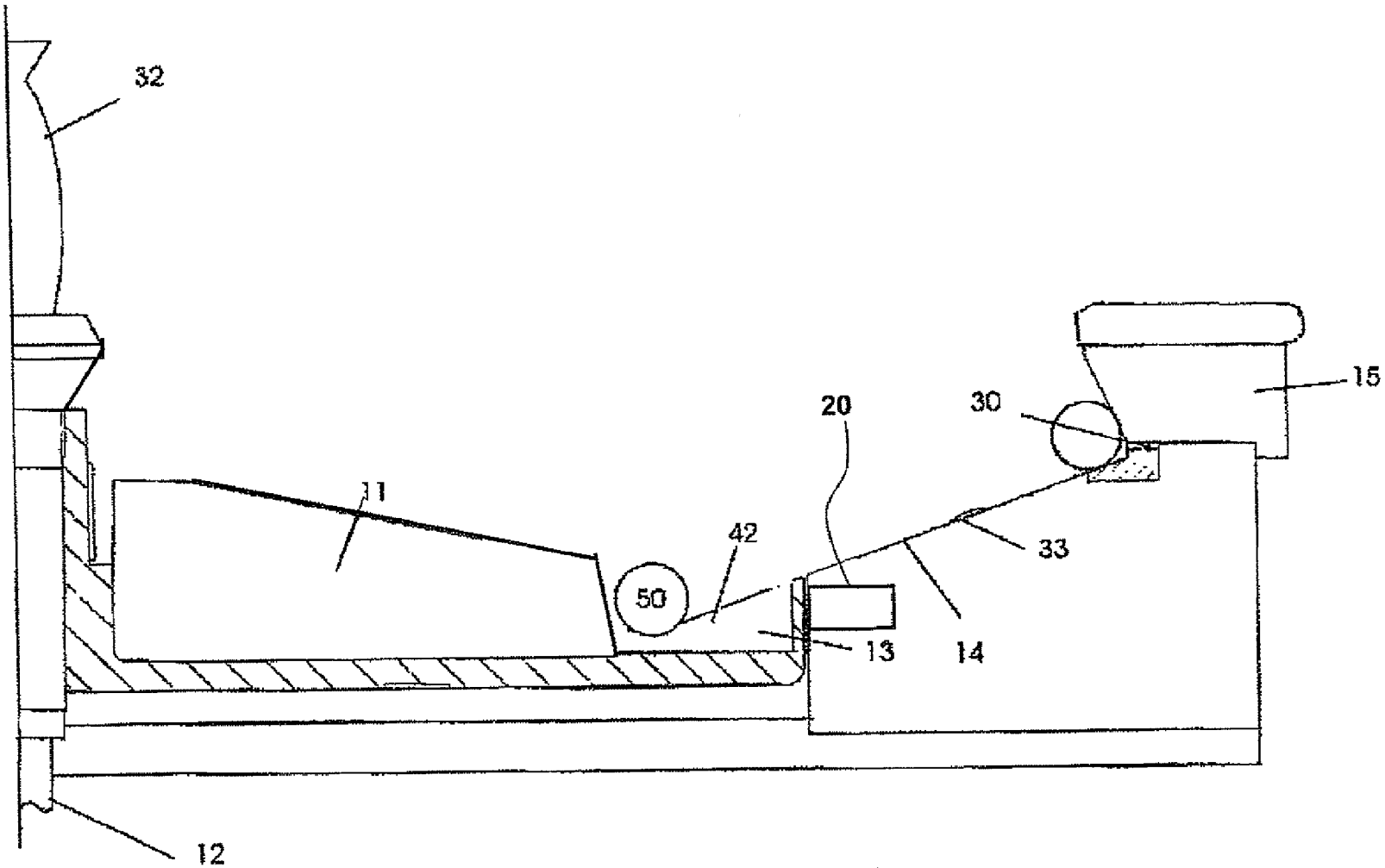
FIG. 1 shows a section view of part of a roulette wheel according to an embodiment of the invention.

Referring to FIG. 1 a roulette wheel has a rotor 11 mounted on an axle 12. There are pockets 13 on the periphery of the rotor and each pocket is numbered and coloured. Surrounding the rotor 11 is a ball track 14. There is a fixed top rim 15 around the ball track 14 in which there is a number recording device (not visible) which detects which pocket a ball is in and enables this number to be displayed and recorded. A turret 32 is mounted over the axle 12.

Rotor control means 20 are provided in the roulette wheel below the ball track so that the rotor control means are not externally visible. The rotor control means 20 are adapted to apply a force to the rotor 11 so as to alter a rotation speed of the rotor in a controlled manner.

Ball interrupters 33 are provided on the inclined surface of the ball track 14 which divide the wheel into sections. The location of the pocket 42 containing the ball 50 is detected by a ball detector 30 as will be described below and the operation of the rotor control means is controlled by a computer (not illustrated).

The rotor 11 is adapted to be spun by a manually applied force. For example, a croupier can spin the rotor in a clockwise or anti-clockwise direction by turning the rotor 11 by hand. When the rotor is rotating the rotor control means 20 are controlled so as to apply a force to the rotor 11 which alters the rotation speed of the rotor 11. Preferably, the rotor control means 20 alter the rotation speed in a gradual and controlled manner so that it is difficult for a user of the roulette wheel to visually perceive the change in rotation speed of the rotor 11 caused by the rotor control means 20.

Thus, it will be appreciated that the roulette wheel of FIG. 1 is a manually spun roulette wheel comprising wheel control means adapted to apply an external force to the wheel so as to alter a rotation speed of the wheel in a controlled manner. The roulette wheel has the visual appearance of a conventional manually spun roulette wheel (for example, unlike an automatic roulette wheel, the rotor and ball track area is not covered by a security cover). The operator operates roulette wheel in the same way as a conventional manual roulette wheel by turning the rotor by hand and then launching the ball 50 around the top rim 15 by hand. The distinction between a conventional manually operated roulette wheel and a roulette wheel according to an embodiment of the invention is in that when the rotor 11 is spinning and the ball has been launched around the top rim 15, rotor control means 20 are operated to apply a force to the rotor which alter the rotational speed of the rotor 11 so as to introduce variability and/or randomness into the rate of deceleration of the rotor 11. Such variation in rotor rotational speed or deceleration can prevent prediction devices making accurate predictions about which pocket 13 or section of the wheel the ball will land in.

Figure 2:
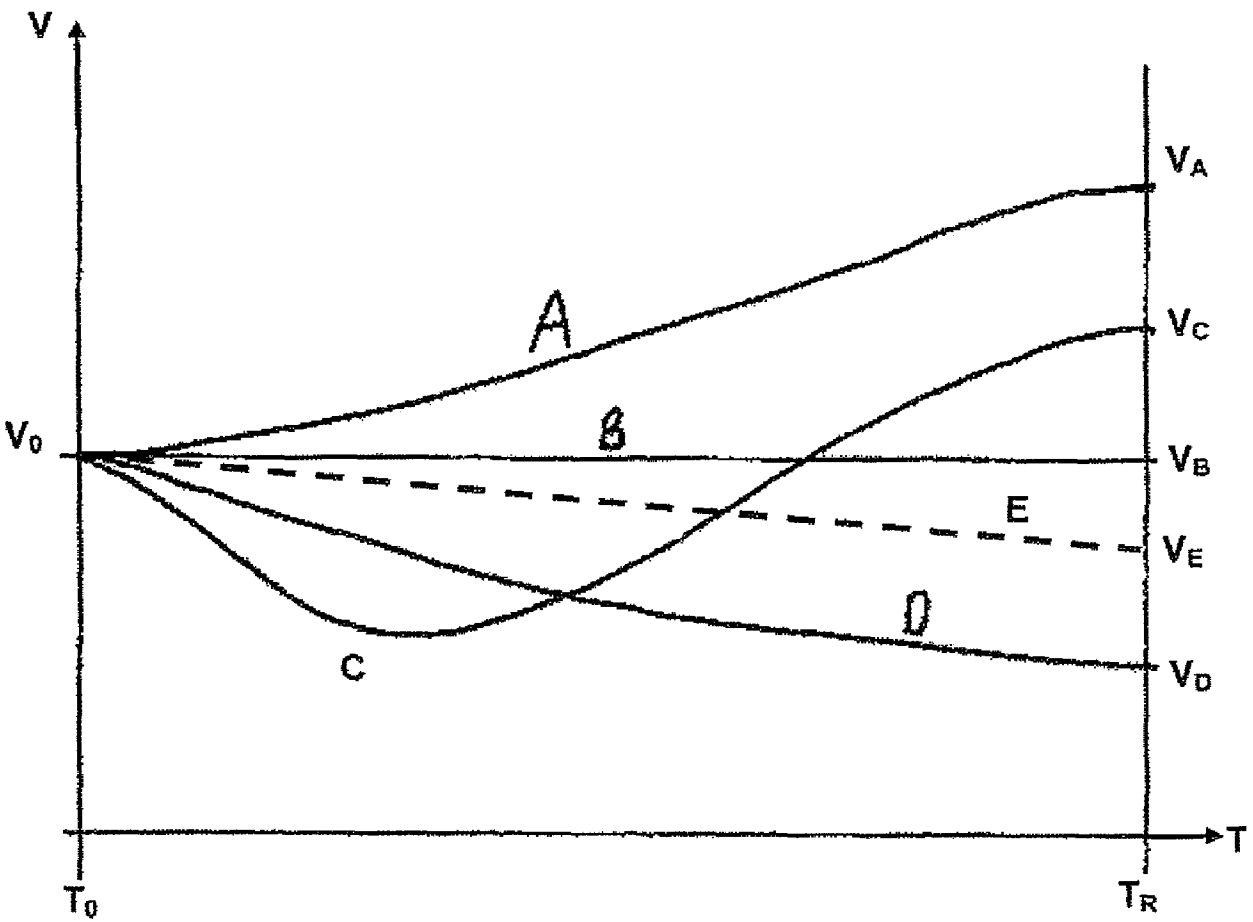
FIG. 2 is graph plotting a angular velocity of a rotor against time for exemplary embodiments of the invention.

Referring to FIG. 2, the force applied to the rotor 11 by the rotor control means 20 may be controlled so as to increase or decrease the angular velocity V of rotor 11, and to do so in a varying manner with respect to time T.

Taking the initial angular velocity of the rotor 11 at time T=0 ($T_0$) as $V_0$, the rotor control means may be controlled so as to monotonically increase the angular velocity V of the rotor 11 over time T so that, when the force applied to the rotor by the rotor control means is remover at time $T_R$, the angular velocity of the rotor has a value $V_A$, where $V_A>V_0$. An example of such a variation in angular velocity with respect to time is illustrated by line A of FIG. 2.

For reference, a rotor having been manually rotated and remaining uninfluenced by any external forces or influences will have an initial angular velocity $V_0$ and final velocity $V_E$ where $V_E$ is less than $V_0$ and the deceleration will have been nominally constant as a result of bearing friction etc. An example of such a variation in angular velocity with respect to time for a conventional manually rotated wheel is illustrated by line E of FIG. 2.

The rotor control means may also be controlled so as to maintain the angular velocity V of the rotor 11 over time T so that, when the force applied to the rotor by the rotor control means is removed at time $T_R$, the angular velocity of the rotor still has a value $V_B$, where $V_B$ is substantially equal to $V_0$. An example of such a variation in angular velocity with respect to time is illustrated by line B of FIG. 2.

The rotor control means may also be controlled so as to monotonically decrease the angular velocity V of the rotor 11 over time T so that, when the force applied to the rotor by the rotor control means is removed at time $T_R$, the angular velocity of the rotor has a value $V_D$, where $V_D<V_0$. An example of such a variation in angular velocity with respect to time is illustrated by line D of FIG. 2.

The rotor control means may also be controlled so as to decrease and then increase the angular velocity V of the rotor 11 over time T so that, when the force applied to the rotor by the rotor control means is removed at time $T_R$, the angular velocity of the rotor has a value $V_C$, where $V_C \neq V_0$. An example of such a variation in angular velocity with respect to time is illustrated by line C of FIG. 2. Of course, it will be understood that the angular velocity V of the rotor 11 may alternatively be increased first and then decreased. It will be appreciated that other variations of the angular velocity V of the rotor 11 may be obtained by controlling the force applied to the rotor by the rotor control means 20 appropriately, and such alternative variations will be readily apparent.

Figure 3:
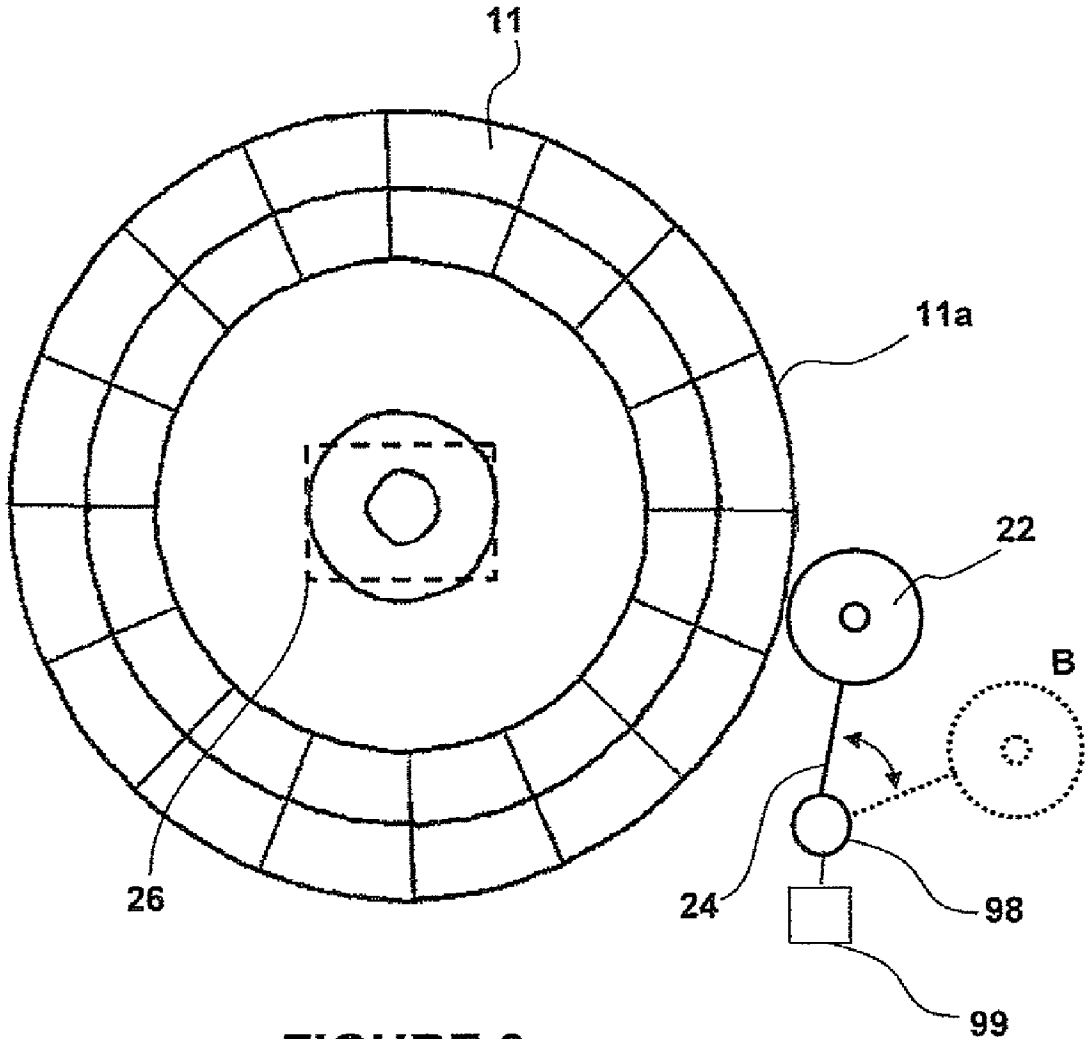
FIG. 3 is a plan view of the rotor and rotor control means of an embodiment of the invention.

Referring now FIG. 3, in an embodiment of the invention the rotor control means 20 comprise a friction roller arrangement having roller 22 connected to a motor 98 and encoder 99 on the end of an arm 24 which is movable between first and second positions. In the first position (as illustrated), the roller 22 contacts the edge 11*a* of the rotor 11 so as to impart a frictional force on the rotor. In the second position (indicated by the dotted lines), the arm 24 is displaced from the first position so that the roller 22 does not contact the rotor 11.

When in the first position, the roller 22 can exert a frictional force on the edge of the rotor, the friction force being sufficient to substantially eliminate slippage between the roller and the rotor so that the motor 98 can be used to increase or decrease the angular velocity of the rotor 11, and may even reverse the direction of rotation of the rotor 11.

To measure the angular velocity of the rotor an encoder 26 is provided at the axle 12 of the rotor 11. The encoder 26 is preferably connected to a computer control system (not illustrated) which is in turn arranged to control the rotor control means 20.

The encoder 99 is used to provide angular velocity feedback of the roller 22 to the rotor control means 20 such that the linear velocity of the roller 22 surface may be initially synchronised to the linear velocity of the rotor edge 11*a* prior to engagement of the two parts by movement of the arm 24 to the first, contacted, position. This is so that engagement of the roller 22 with the rotor 11 does not cause a visible change to the rotation velocity of the already rotating rotor 11.

After engagement of the roller 20, the motor 98 may be controlled by a computer to effect minor change to the velocity of the rotor as required.

Figure 4:
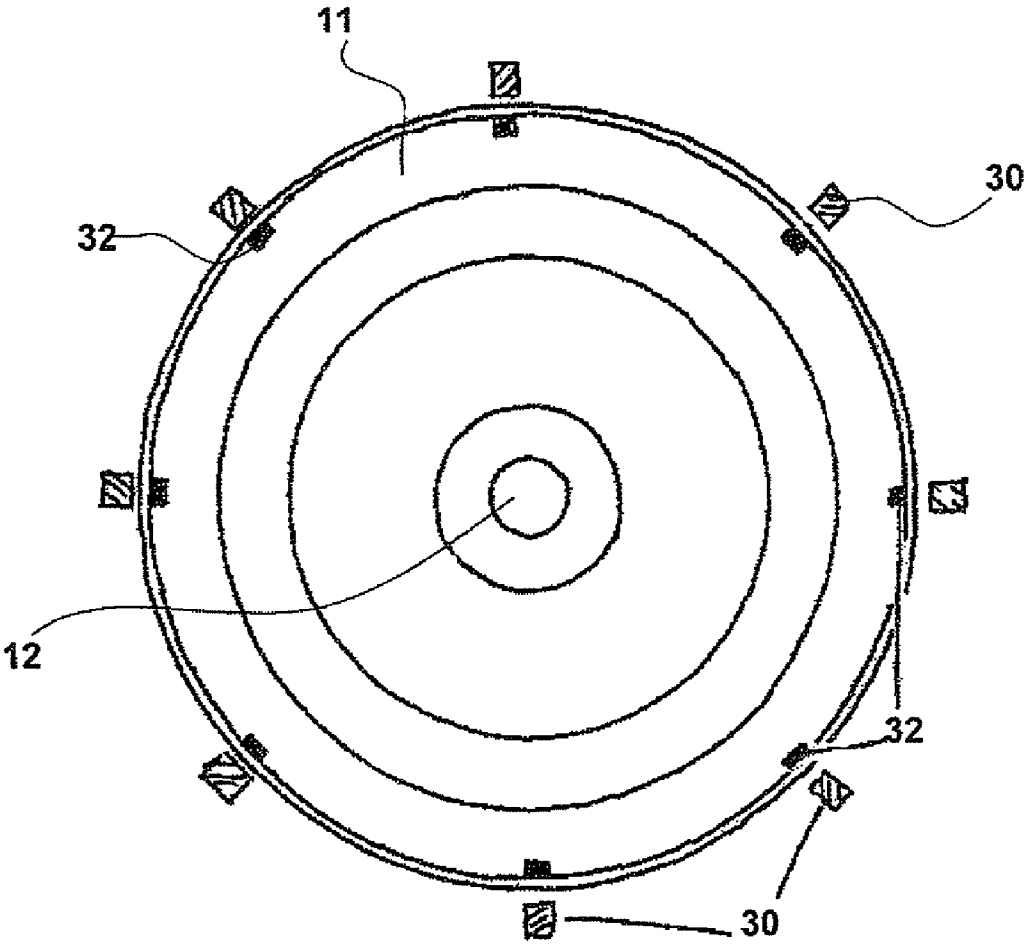
FIG. 4 is a plan view of the rotor and rotor control means of an alternative embodiment of the invention.

Referring to FIG. 4, the rotor control means 20 of an alternative embodiment comprise an arrangement of electromagnets 30 which are controlled so as to apply a magnetic force to magnets 32 spaced around the circumference of the rotor 11. In more detail, magnets 32 are provided near the edge of the rotor 11 and are spaced around the circumference of the rotor 11. Electromagnets 32 are provided at intervals around the edge of the ball track 14 adjacent to and surrounding the circumferential edge of the rotor 11. Each electromagnet 30 is connected to an electrical supply (not shown) and the electrical supply to each electromagnet 30 is controlled by a computer control system (not shown) so that an electromagnetic field can be produced by each of the electromagnets 30 and appropriately controlled in both electromagnetic field strength and timing. An encoder is mounted to the rotor axis to provide angular velocity feedback and to facilitate timing of the electromagnet energisation relevant to the passing magnets on the rotor.

By applying an electrical current to one or more of the electromagnets 30 while the rotor 11 rotates about its axis, a resultant electromagnetic field produced by the respective electromagnet(s) 30 causes the magnets 32 to experience a directional force as they move past the electromagnet(s) 30 and through the corresponding electromagnetic field. The directional force experienced by the magnets 32 alter the angular velocity V of the rotor 11, depending on the direction of rotation of the rotor and the direction of the force experienced by the magnet(s) 32. Thus, by controlling of the currents applied to the electromagnets 30, and on/off timing thereof, a force can be exerted on the rotor so as to alter its angular velocity. This force can be used to increase and/or decrease the angular velocity with respect to time in a similar fashion to that illustrated in FIG. 2, for example.

Figure 5:
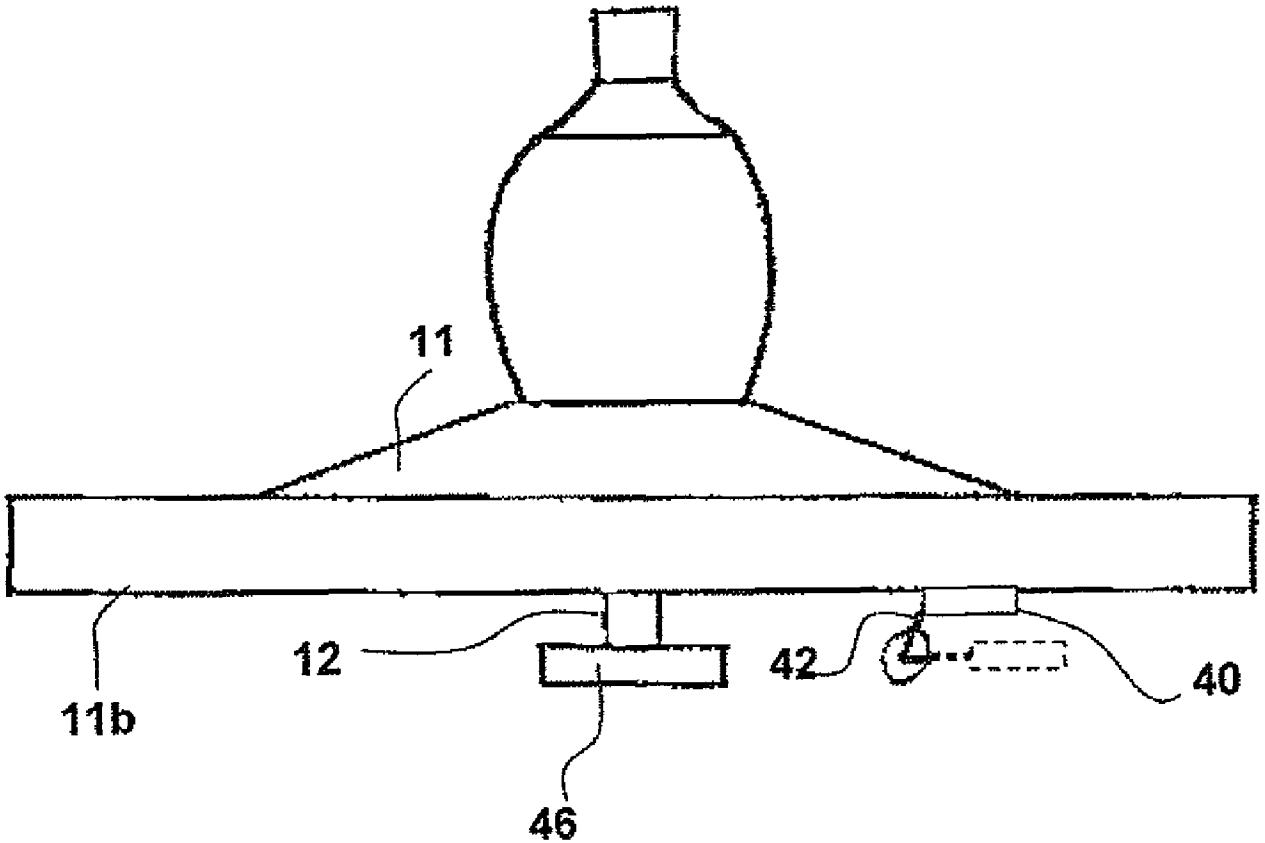
FIG. 5 is a side view of the rotor and rotor control means of another embodiment of the invention.

Referring now to FIG. 5, the rotor control means 20 in yet another embodiment of the invention comprise a braking pad arrangement having friction pad 40 on the end of an arm 42 which is movable between first and second positions below the rotor 11. In the first position (as illustrated), the friction pad 40 contacts the lower surface 11*b* of the rotor 11 so as to impart a frictional braking force on the rotor 11. In the second position (indicated by the dotted lines), the arm 42 is displaced from the first position so that the friction pad 40 does not contact the rotor 11.

When in the first position, the friction pad 40 exerts a frictional force on the rotor 11 so as reduce the angular velocity of the rotor 11, in a similar fashion to a frictional brake. In this way, the friction pad 40 can be used to decrease the angular velocity of the rotor 11, and the resultant decrease in angular velocity V may be controlled by controlling the pressure exerted on the rotor by the friction pad 40 when in the first position.

The arm 42 can be made movable between first and second positions by means of a lever which is operated by the croupier for example. In this way, the embodiment is purely mechanical and does not require electrical power to operate, therefore enabling installation and use in areas where an electrical power supply is unavailable or difficult/costly to provide.

Similarly to the embodiment of FIG. 3, an encoder 46 is provided at the axle 12 of the rotor 11 to measure the angular velocity of the rotor. The encoder 26 is connected to a computer control system (not illustrated) which is, in turn, arranged to control the braking pad arrangement.

A sequence for one embodiment of the invention is:

1. The ball is sitting in a pocket in the rotating rotor as the previous game has closed. The location of the ball has been detected by a sensor or determined by the dealer.
2. The dealer removes the ball from the pocket by hand and invites new bets to be placed for the next game.
3. The dealer spins the rotor of the wheel by turning the rotor by hand in either a clockwise or anti-clockwise direction.
4. The dealer then launches the ball around the top rim by hand.
5. A ball detector in the top rim of the roulette wheel detects that the ball has been launched and an encoder in the roulette wheel detects that the rotor is spinning and associated angular velocity of the rotor. Based on signals from the ball detector and the encoder, the rotor control means are operated and controlled so as to apply a force to the rotor which alters the rotational speed of the rotor in a way which introduces variability and/or randomness into the angular velocity of the rotor. Such variation in rotor rotational speed or deceleration can prevent prediction devices making accurate predictions about which pocket or section of the wheel the ball will land in.
6. The "no more bets" signal is given and the ball spirals down and comes to rest in a pocket. The location of the ball in the pocket is detected by a sensor or determined by the dealer. Payouts etc. can then be made.
7. The sequence is then repeated. The force applied to the rotor by the rotor control means in the next and subsequent games can be modified so as to reduce predictability of the roulette wheel.

The invention recreates a conventional roulette wheel, except that variability in the angular velocity of the rotor can be achieved. Preferably, the angular velocity of the rotor is modified in such a way that a user of the wheel is unable to see, hear or perceive that rotation of the rotor is being altered by a force other than those expected to slow the rotor as it rotates.

Investigations have shown that gently speeding the rotor up is more noticeable than slowing a rotor down, even when the rate of change of the rotor speed is the same. It has also been found that whether not a user is typically unable to perceive that the rotational speed of the rotor is being modified by an applied force depends on when the force is applied during a game of roulette. For example, immediately after the ball is launched around the ball track by the croupier, it is harder for a user to perceive an adjustment in the rotational speed of the rotor, because the fast moving ball and rotor distracts the user's attention. Furthermore, the degree to an adjustment in the rotational speed of the rotor can be noticed also depends on the rotational speed of the rotor at the time of adjustment.

In essence, for an embodiment of the invention to combat the use of prediction devices, the rotational speed of the rotor should preferably be adjusted to such a degree that the ball falls into a pocket in a different section of the wheel from what it would have otherwise fallen into if the rotor speed was not altered. Thus, the rotation of the rotor should preferably be modified so that it is between ¼-½ of a revolution offset compared to its unmodified position when a ball falls into a pocket. Thus, over the course of one game (i.e. from the time when the ball is propelled by the croupier to the time when the ball falls in to a pocket) the adjustment of the rotor should preferably be within the range of $\pi/2$ to $\pi$ radians (90° to 180°) to completely neutralize any bias deliberately created by a dealer or as calculated by a clocking device. In other words, it is desirable that the end point of the rotor is modified by (plus or minus) 180° from its natural finishing position. Such an adjustment may be made gradually over the duration of a single game, say 15-30 seconds, or may be made in a short time period, say ½-1 second. Thus, in embodiments of the invention, the magnitude of the acceleration/deceleration rate is less than $\pi/4$ rads/s$^2$, preferably less than $\pi/8$ rads/s$^2$, more preferably less than $\pi/16$ rads/s$^2$, and even more preferably less than $\pi/32$ rads/s$^2$ In order to ascertain the limits by which the rotor speed may be adjusted without appearing abnormal, a series of tests were performed and witnessed by different people. From this it has been established that the required modification to the end point (i.e. plus or minus 180°) after 15 seconds (the typical duration of a single game) is well inside the range in which the rotor speed may be adjusted without appearing abnormal. Thus, it is possible to completely neutralize any bias without any obvious perceptible change to the behaviour of the rotor.

Furthermore, the required range of adjustment can be achieved without needing to speed up the rotor at all. Investigations have shown that a modification of plus or minus 180° can be attained by maintaining the rotor at a constant speed. This has an additional benefit, since it has been found that speeding up the rotation of the rotor is subjectively more noticeable than slowing down the rotation of the rotor.

While specific embodiments have been described herein for purposes of illustration, various modifications will be apparent to a person skilled in the art and may be made without departing from the scope of the invention.

For example, the rotor control means may be adapted to rapidly disengage from the rotor if and when the dealer/croupier intervenes with rotor (to stop it rotating, for example).

The invention claimed is:

1. A manually spun roulette wheel comprising:

a rotatably mounted rotor having pockets into which a ball can be received, the rotor being adapted to be spun by a manually applied force; and rotor control means adapted to apply a force to the rotor so as to alter a rotational speed of the rotor, wherein the rotor control means are adapted to vary the applied force.

2. The manually spun roulette wheel of claim 1, wherein the rotor is adapted to rotate in both clockwise and anti-clockwise directions, and wherein the rotor control means are adapted to alter the rotational speed in either of the clockwise and anti-clockwise directions.

3. The manually spun roulette wheel of claim 1, wherein the rotor control means are adapted to vary the applied force between spins of the rotor.

4. The manually spun roulette wheel of claim 1, further comprising a control unit adapted to control the rotor control means.

5. The manually spun roulette wheel of claim 4, further comprising a ball detector adapted to detect the presence of a ball at a location in the gaming apparatus, wherein an output of the ball detector is arranged to be provided to the control unit.

6. The manually spun roulette wheel of claim 4, further comprising a speed detector adapted to detect the rotational speed of the rotor, wherein an output of the speed detector is arranged to be provided to the control unit.

7. The manually spun roulette wheel of claim 1 wherein the rotor control means comprise:

a frictional pad movable been first and second positions, wherein the frictional pad contacts the rotor when in the first position and wherein the frictional pad does not contact the rotor when in the second position.

8. The manually spun roulette wheel of claim 1, wherein the rotor control means comprise:

a roller movable been first and second positions, wherein the roller contacts the rotor when in the first position and wherein the roller does not contact the rotor when in the second position.

9. The manually spun roulette wheel of claim 8, further comprising a motor adapted to rotate the roller about a drive axis so as to increase or decrease the rotational speed of the rotor when in the first position.

10. The manually spun roulette wheel of claim 1, wherein the rotor comprises a magnet, and wherein the rotor control mean comprises at least one electromagnet adapted to create an electromagnetic field through which the magnet of the rotor is adapted to pass as the rotor rotates.

11. The manually spun roulette wheel of claim 1 wherein the apparatus is a manually rotated roulette wheel.

12. The manually spun roulette wheel of claim 1 wherein the rotor control means are adapted to alter a rotational speed by less than $\pi/4$ rads/s$^2$.

* * * * *